US005228733A

United States Patent [19]

Winters

[11] Patent Number: 5,228,733

[45] Date of Patent: Jul. 20, 1993

[54] SAFETY LOCK FOR SLIDING GLASS DOORS

[76] Inventor: John R. Winters, 263 Kensington St., Port Charlotte, Fla. 33954

[21] Appl. No.: 981,206

[22] Filed: Nov. 25, 1992

[51] Int. Cl.[5] ..... E05B 21/00

[52] U.S. Cl. ..... 292/300; 292/DIG. 46; 292/DIG. 60

[58] Field of Search ..... 49/404; 292/300, 302, 292/DIG. 46, DIG. 47, DIG. 60

[56] References Cited

U.S. PATENT DOCUMENTS

| | | | |
|---|---|---|---|
| 3,055,064 | 9/1962 | Riegelman | 292/DIG. 46 X |
| 3,172,145 | 3/1965 | Miller | 292/DIG. 46 X |
| 3,975,041 | 8/1976 | Edison | 292/DIG. 46 X |
| 4,526,412 | 7/1985 | Gist | 292/DIG. 46 X |
| 4,656,781 | 4/1987 | Niekrasy et al. | 49/404 |
| 4,971,374 | 11/1990 | Lovell et al. | 292/DIG. 46 X |
| 5,113,629 | 5/1992 | Cerrick | 292/DIG. 46 X |

*Primary Examiner*—Richard E. Moore

*Attorney, Agent, or Firm*—Frank A. Lukasik

[57] ABSTRACT

A safe and tamper resistant safety lock system for the top of sliding glass doors and consists of a metal bracket fastened to the top edge of the door, positioned on the door with a screw which is normally found in each door, and then permanently fastened to the door with a second screw. A top, horizontal section, is formed by bending a first end of a metal plate, and extends over the top of the sliding door. The safety lock system is adjusted to reduce the gap between the top of the door and the top of the upper track to prevent lifting of the door out of the bottom track.

1 Claim, 1 Drawing Sheet

SAFETY LOCK FOR SLIDING GLASS DOORS

BACKGROUND OF THE INVENTION

1. Field of the invention

This invention relates generally to door locking systems, and more particularly, to a locking assembly for use in slidable doors and the like.

2. Discussion of the prior art

Sliding doors and windows are finding wide current architectural usage because they are inexpensive to construct and do not require clearance in the interior of the building. Despite these advantages, they have been an easy point of entry for burglars and other types of criminals. To date, most of the locking mechanisms for sliding glass panels of this type have been primitive and unsatisfactory. Many of these locks can be overcome by simply forcing a pry bar between the door or window and it's casing and applying a moderate amount of force. In view of this well-known weakness, most homeowners adopt the expedient of laying a dowel in the lower track of the sliding panel. While this may discourage the unskilled thief, it is usually not effective against the professional burglar who can often insert a thin bar along the edge of the window and flip the dowel out of the channel. This is especially easy to do if the door has been slightly opened to obtain better ventilation.

Another common security device is a hinged bar across the door. This is attached at one end to the door or window frame while the other end rests in a channel attached to the casing. This bar needs only be lifted from the retaining channel in order to open the door. Once again, enterprising thieves have devised tools and means to accomplish this purpose in a fair number of installations.

Various devices have been proposed in the art for increasing the locking security of a patio door, so that an intruder or other unauthorized person cannot force the door unless he resorts to smashing the entire glass panel. One such prior art locking device is shown in U.S. Pat. No. 4,295,676 which includes a pair of telescoping members that are adjustably interconnected to have either a greater or lesser length. One of the telescoping members attaches to a keeper on the sliding door, and is non-removably retained in the keeper whenever the shorter length is selected so that the door may be ajar, or when the door is locked in the fully closed position. U.S. Pat. No. 3,608,940 discloses a sliding door security lock of telescoping members limited in movement in a contracted direction. One end being attached to the frame of the sliding door itself and the other end being attached to the doorjamb or a second door in the doorjamb. Both attachments are releasable, one by retracting one member when the door is closed and the other by angularly moving the other member when the one member is retracted. The one member is latched by a pivoted coaxial keeper in its telescoping position and the latch is held by the other member when the door is open.

U.S. Pat. No. 4,102,545 discloses a lock assembly which includes a specially configured bracket which is mounted upon the stationary frame assembly of the door unit. The bracket is mounted upon the stationary frame assembly of the door unit. The bracket has an inverted "J" shaped channel and an elongated wall defining a plurality of apertures including one aperture which is positioned to overlie an aperture in the slidable frame of the door when the door is in a closed position and another aperture which is positioned to overlie the aperture in the slidable frame when the door is in a partially opened position. A specially configured locking key is provided with a cylindrical shank having an arcuate locking cam for lockably engaging the inverted "J" shaped channel bracket when the shank is inserted into the aperture in the slidable frame into one of the apertures in the bracket.

U.S. Pat. No. 4,493,501 discloses a toggling pair of bars, one of which is attached to the door frame and the other to the casing so that the bar lies across the fixed pane. The first bar is an inverted channel which encloses a portion of a second preferably solid bar. A pair of longitudinally side by side holes is drilled through both bars in the overlapping portion. The bars are joined in this area by one or more pins inserted through the holes. One hole is located adjacent to the distal end of the solid bar so that it can act as a pivot when the bars are united by a pin passing through this hole. The bars can then toggle to permit the door to be opened. If both holes are pinned or if a single pin is placed so that it passes through the other hole in the solid bar assembly is securely locked.

Other sliding door locking devices are shown in U.S. Pat. Nos. 4,790,157; 4,563,885; 4,763,497; and 4,754,624. Other means which offer a higher degree of security are known, but these are considered by most people to be undesirable from points of complexibility, expense, or appearance. There has been a major unfilled need for a highly effective security device for sliding doors or windows that is simple, moderately priced, and does not detract from the esthetic appearance.

SUMMARY OF THE INVENTION

The present invention is a safety lock for the top of sliding glass doors or windows and consists of a metal bracket fastened to the top edge of the door, located on the door with a screw which is normally found in each door and then permanently fastened to the door with a second screw. The safety lock of the invention closes the gap between the top surface of the sliding door or window and the bottom of the sliding track fastened to the top of the door opening.

It is an object of the invention to provide a locking mechanism for a sliding door or window which is inexpensive, simple in construction, and esthetic in appearance.

It is another object to provide a locking mechanism for a sliding door or window which is highly effective.

These and many other objects will become readily apparent to those skilled in the art upon reading the following detailed description taken in conjunction with the drawings.

DESCRIPTION OF THE PREFERRED EMBODIMENT

Figure 2:
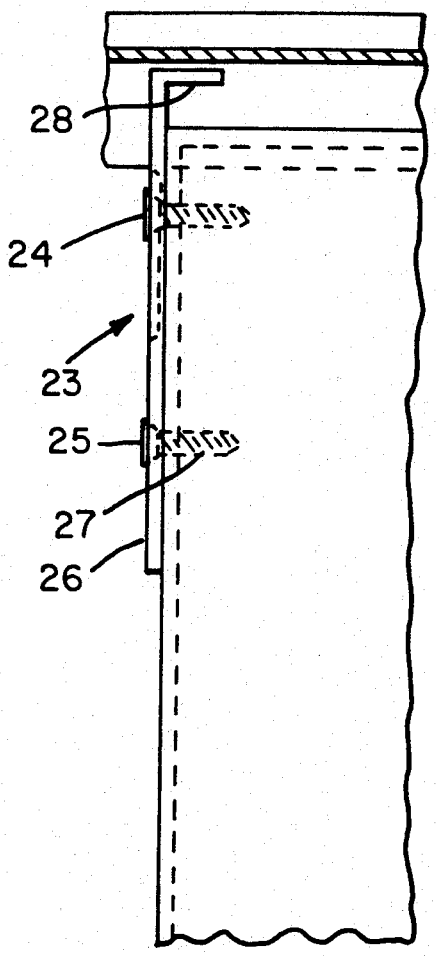
FIG. 2 is a side elevational view, partially in section, showing the locking mechanism in place on a sliding door.
Figure 3:
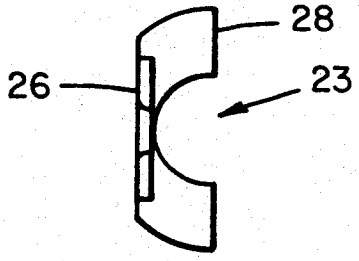
FIG. 3 is a bottom view of the locking mechanism of the invention.
Figure 1:
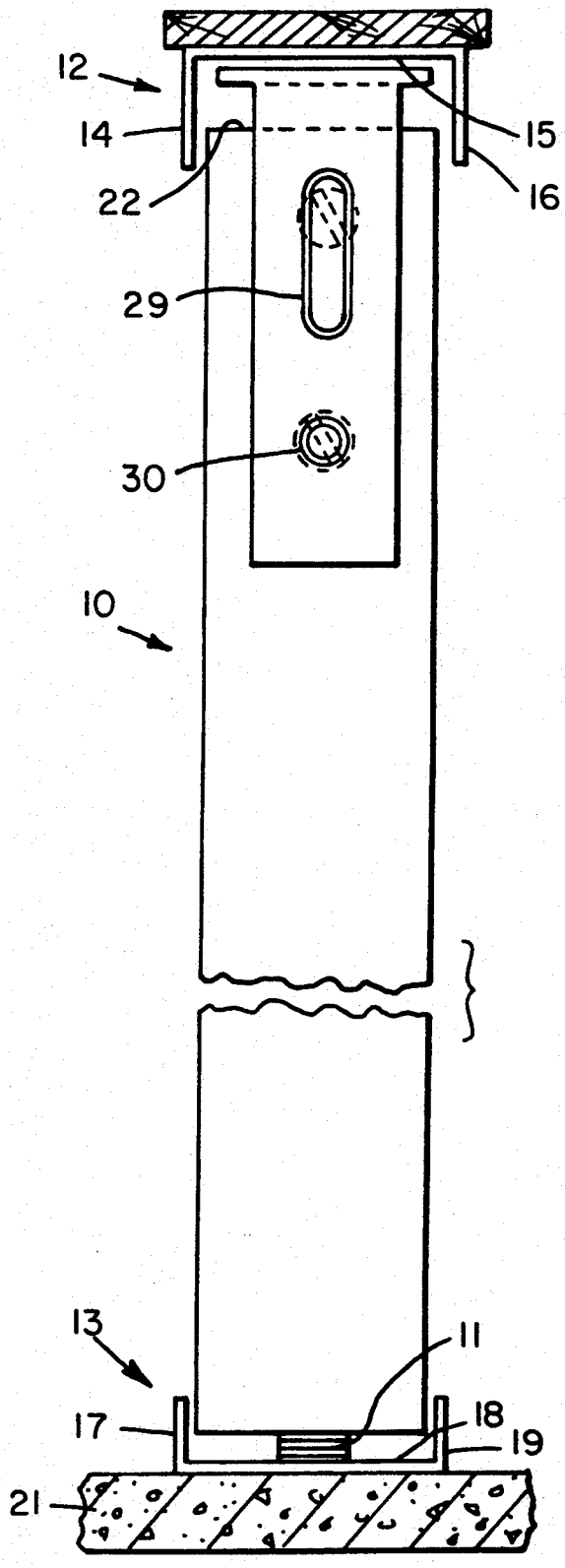
FIG. 1 is a front elevational view, partially in section, showing the locking system in place on a sliding door.

Turning to FIGS. 1 and 2, there is shown generally a patio door fragmentally indicated at 10. It will be understood by those skilled in the art that the conventional sliding panel or door 10 is supported by rollers 11 or the like for sliding movement along tracks, provided by the upper track 12 and lower track 13 portions. Upper track 12 contains vertical outer wall means 14, top 15, and vertical inner wall means 16. Lower track 13 contains vertical outer wall means 17, horizontal base means 18, and vertical inner wall means 19.

It will be understood by those skilled in the art that the conventional sliding panel or door 10 is supported by rollers 11 or the like for sliding movement along the lower track 13 and guided by the upper track 12. Lower track 13 is shown on flooring 21 which may be concrete or wood or the like. Upper track 12 and lower track 13 may be substantially U-shaped aluminum extrusions which provide a slidable fit for door 10. Usually, during the installation or construction of sliding doors, a gap remains between the top 22 of door 10 and top 15 of upper track 12. Consequently, burglars have been known to insert prying tools into the lower track 13 and by supplying sufficient force, lift the door 10 upwardly, out of the lower track 13 and then pull it out of the upper track 12 and gain entry into the house or apartment.

The safety lock 23 of the invention is shown mounted on door 10 with two screws 24 and 25 in a position to prevent lifting of the door 10 with a prying tool. Safety lock 23 is preferably made of stainless steel, steel, aluminum or other similar material. The vertical section 26 is sufficiently long to reach from a point above the top of the door 10 to a point sufficiently long to extend downwardly to a point where a second drill hole 27 may be made to fix the location of safety lock 23 in operating position. Horizontal section 28 is formed by bending at the upper end of section 26. The length of section 28 is sufficient to provide a wide surface to stiffen the part to prevent bending under pressure and the width is narrower than the door 10 but wide enough to provide sufficient material to prevent side movement in the track 12.

Slot 29 provides the means to locate safety lock 23 in its operative position by using the screw 24, which is normally found on standard glass doors, to guide the lock 23 as it is being set, and when tightened, to hold the lock 23 until hole 27 is drilled in door 10. Slot 29 and hole 30 are chamfered to provide a seat for screws 24 and 25. After hole 27 is drilled, screw 25 is inserted and screwed in tightly. The combination of screws 24 and 25 provide sufficient holding power to prevent vertical or horizontal movement of safety lock 23 if an attempt is made to lift the door 10 from its lower track 13. In the event that the door 10 does not have a screw such as screw 24 available, safety lock 23 may be used to locate a location for the screw 24 and a hole may be drilled.

The safety lock 23 may also be used on a second sliding door 10 panel as in the case of "pocket" doors where both panels slide open. In addition, safety lock 23 may also be used on single or double sliding glass windows. The safety lock 23 may easily be installed or removed whenever the door requires maintenance or is to be replaced. Restricting the vertical movement of door 10 eliminates the need for complex, expensive, door locks which are normally required for security with standard door tracks. It should be understood that the foregoing relates only to a disclosed embodiment of the present invention, and that numerous changes or modifications may be made therein without departing from the spirit or the scope of the invention as defined in the following claims.

What is claimed is:

1. A safety locking system for a sliding door or window for limiting vertical movement within an upper and lower track, which comprises:

a vertical section sufficiently long to reach from a point above the top of said door or window and extending downwardly to a point where a hole can be drilled in said door for fastening said locking system, said vertical section having a first and second end, a chamfered vertical adjusting slot beginning near said first end, and a chamfered hole located near said second end, said vertical section being secured to said door with screws inserted through said vertical adjusting slot and said hole, and a horizontal section, formed by bending said vertical section at said first end, and having sufficient length to provide a wide surface to stiffen said section to prevent bending under pressure and having sufficient width to prevent side movement of said door within said upper track.

* * * * *